US008424351B2

(12) United States Patent
Zdravkovic et al.

(10) Patent No.: US 8,424,351 B2
(45) Date of Patent: Apr. 23, 2013

(54) AUTOMATED MONITORING FOR CLINCHING JOINTS

(75) Inventors: Srecko Zdravkovic, Sterling Heights, MI (US); Sivakumar Ramasamy, Utica, MI (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 13/047,216

(22) Filed: Mar. 14, 2011

(65) Prior Publication Data

US 2011/0162184 A1 Jul. 7, 2011

Related U.S. Application Data

(60) Division of application No. 12/701,951, filed on Feb. 8, 2010, now Pat. No. 7,905,127, which is a division of application No. 10/544,932, filed on Jun. 6, 2006, now Pat. No. 7,658,089, which is a continuation of application No. PCT/US2004/004529, filed on Feb. 13, 2004.

(60) Provisional application No. 60/477,284, filed on Jun. 10, 2003.

(51) Int. Cl.

| | |
|---|---|
| ***B21C 51/00*** | (2006.01) |
| ***B23Q 17/20*** | (2006.01) |
| ***B23P 21/00*** | (2006.01) |

(52) U.S. Cl.
USPC ..... 72/21.1; 72/17.1; 72/18.9; 29/407.01; 29/715

(58) Field of Classification Search ..... 72/3, 4, 72/15.3, 15.5, 16.2, 16.8, 17.2, 17.3, 19.6, 72/20.1, 20.2, 466.4, 466.5, 17.1, 18.9, 21.1; 29/407.01, 407.09, 407.1, 505, 524.1, 34 B, 29/714, 715, 243.53
See application file for complete search history.

(56) References Cited

U.S. PATENT DOCUMENTS

| | | | | |
|---|---|---|---|---|
| 5,150,513 | A * | 9/1992 | Sawdon | 29/798 |
| 5,581,860 | A * | 12/1996 | Sawdon | 29/243.5 |
| 5,724,843 | A * | 3/1998 | Kirii et al. | 72/17.2 |
| 6,067,696 | A * | 5/2000 | Cecil et al. | 29/407.01 |
| 6,089,062 | A * | 7/2000 | Zemp | 72/21.4 |
| 6,502,008 | B2 * | 12/2002 | Maurer et al. | 700/175 |

* cited by examiner

*Primary Examiner* — Debra Sullivan
(74) *Attorney, Agent, or Firm* — Michael P. Leary

(57) ABSTRACT

A system for monitoring clinched joints performed by an apparatus that moves a punch relative to a die. The system determines acceptability of a clinched joint by correlating the amount of punch advancement toward the die in the formation of the joint and the diameter of a button formed by the joint.

8 Claims, 6 Drawing Sheets

AUTOMATED MONITORING FOR CLINCHING JOINTS

CROSS-REFERENCE TO RELATED APPLICATION

This application is a divisional of U.S. patent application Ser. No. 12/701,951, filed on Feb. 8, 2010, which is a divisional of U.S. patent application Ser. No. 10/544,932, filed on Feb. 13, 2004, which is a continuation of PCT Application No. PCT/US2004/004529, filed Feb. 13, 2004, which claims priority to U.S. Application No. 60/447,284 filed Feb. 14, 2003, all of which are incorporated herein by reference.

BACKGROUND OF THE INVENTION

This invention is concerned with clinched joints, and more particularly, with automated monitoring of clinching to ensure the quality of clinched joints, including, but not limited to, the quality of button diameter and button bottom thickness.

Among the well-known ways of joining sheets of metal are so-called clinched joints in which the operation of a punch relative to a die deforms contiguous metal sheets in a manner that produces a joint button interlocking the sheets. One form of clinching apparatus uses a die having die segments that are displaced laterally relative to a die anvil during formation of a joint. See, e.g., U.S. Pat. No. 5,150,513 issued Sept. 29, 1992 and U.S. Pat. No. 5,581,860 issued Dec. 10, 1996. While such clinching apparatus is capable of making excellent clinched joints, there are occasions when the joints are unacceptable, because, for example, the bottom of the joint button is too thin.

BRIEF DESCRIPTION OF THE INVENTION

The present invention provides a system for monitoring the performance of clinching apparatus of the type just described, for determining whether clinched joints are acceptable or unacceptable, and for determining whether wear of the punch and/or die is excessive.

To accomplish this, the invention monitors button diameter and amount of punch advancement in forming a joint, correlates acceptable values of each, indicates when an unacceptable joint has been produced, and indicates when wear of punch and/or die has become excessive.

BRIEF DESCRIPTION OF THE DRAWINGS

The invention will be further described in conjunction with the accompanying drawings, which illustrate preferred (best mode) embodiments, and wherein.

DETAILED DESCRIPTION OF THE INVENTION

Figure 1:
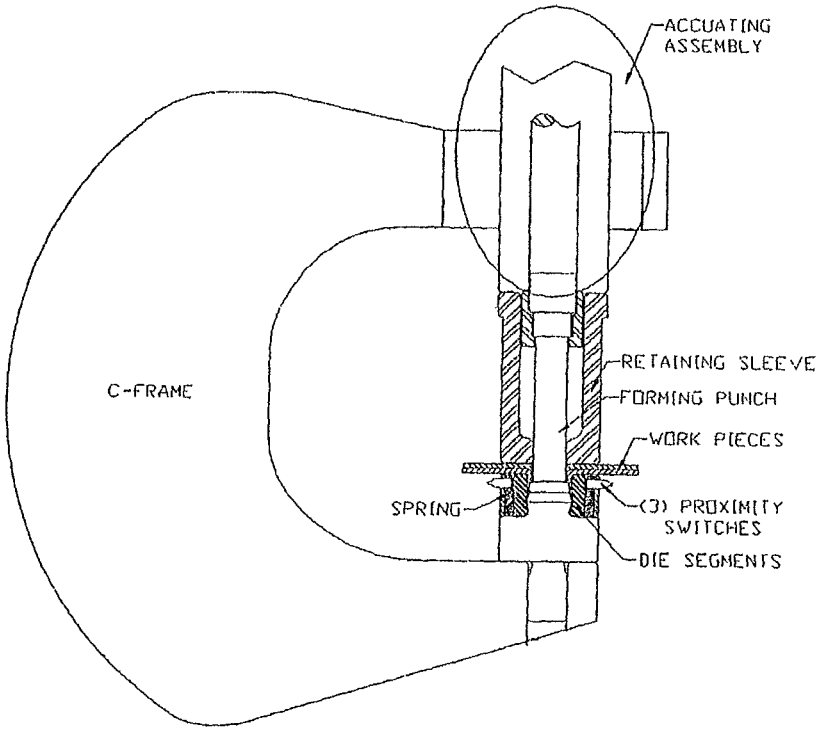
FIG. 1 is a diagrammatic view, partly in section, illustrating one embodiment of clinching apparatus with monitoring components.
Figure 2:
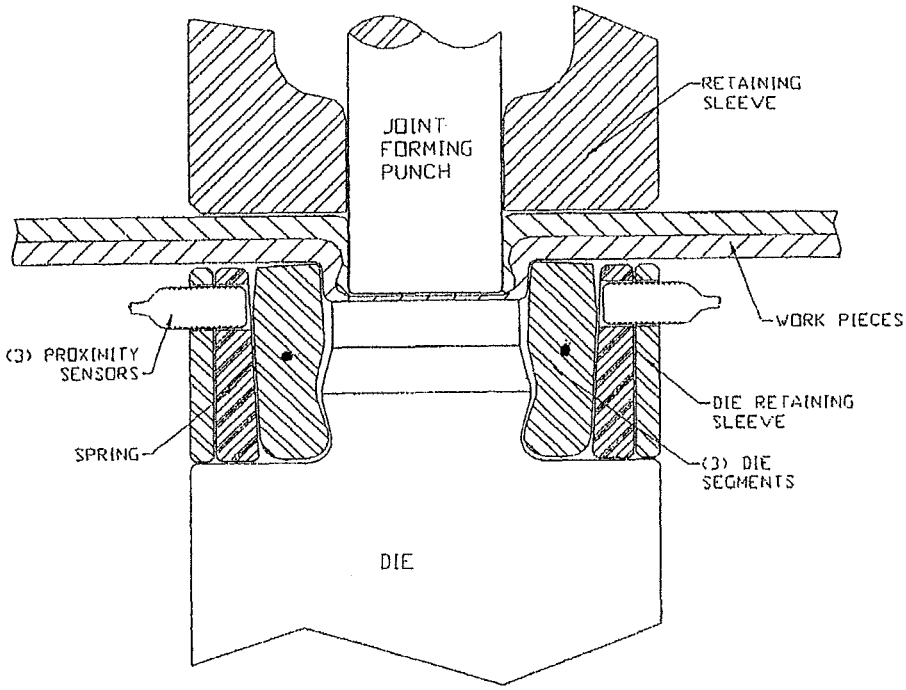
FIG. 2 is a fragmentary enlarged sectional view showing a portion of the apparatus of FIG. 1.

As shown in FIGS. 1 and 2, a machine or apparatus suitable for implementing the invention may comprise a C-Frame, an Actuating Assembly (actuator) mounted on the C-Frame, a Forming Punch supported on the C-Frame for reciprocative movement in a Retaining Sleeve toward and away from a Joint Forming Die (see FIG. 2) and a Controller (see FIG. 4) preferably including a microprocessor. In one embodiment, the Actuating Assembly mounted on the C-Frame is powered by an electrical servo motor, and transfers rotational motion of a planetary roller screw into linear motion of the joint Forming Punch. U.S. Pat. No. 6,502,008 issued Dec. 31, 2002 discloses an example of an actuating assembly suitable for use in the present invention.

Figure 4:
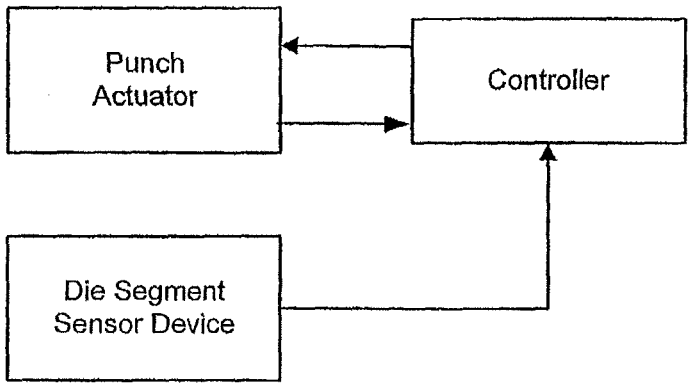
FIG. 4 is a simplified block diagram of monitoring apparatus in accordance with the invention.

In the embodiment shown in FIGS. 1 and 2, the control of button diameter utilizes a sensor device including individual proximity switch sensors that sense displacement of pivoting die segments (e.g. three die segments equally spaced circumferentially) that cooperate with the die anvil and the punch in forming a clinched joint by which work pieces (e.g., sheets of metal) are joined. The proximity switches, more generally sensors, sense displacement of the associated die segments. As shown in FIG. 4, the controller (more particularly, the microprocessor thereof) receives information from the die segment sensor device and controls the punch actuator, which controls the movement of the punch. As the clinching process proceeds and the punch advances toward the die, the die segments are moved outwardly, i.e., laterally relative to the die anvil. When the button diameter reaches a predetermined size, the sensors will signal the microprocessor to stop the punch movement and to start to move the punch backwardly (i.e., retract the punch). FIG. 2 shows, in greater detail, the formation of the button by the cooperation of the punch, the die anvil and the die segments, which are biased inwardly toward the die anvil by springs or other resilient means between the die segments and a die retaining sleeve.

The microprocessor can be used to control the amount of punch movement toward the die, by, e.g., controlling the number of rotations of a servo motor which powers the actuator, in order to control the button bottom thickness. The processor can store information representative of a predetermined range of acceptable button bottom thickness. When the sensors controlling the button diameter, as described above, indicate that a desired button diameter has been reached, and the joint-forming movement of the punch is stopped, the number of rotations of the servo motor up to the time that the punch is stopped will indicate whether the button bottom thickness is within the desired range. As indicated in FIG. 4, the punch actuator supplies such information to the controller. If the punch advances more than a predetermined amount in forming the button, meaning that the button bottom is too thin, this will indicate that the punch and/or the die are worn and need to be replaced.

Figure 3:
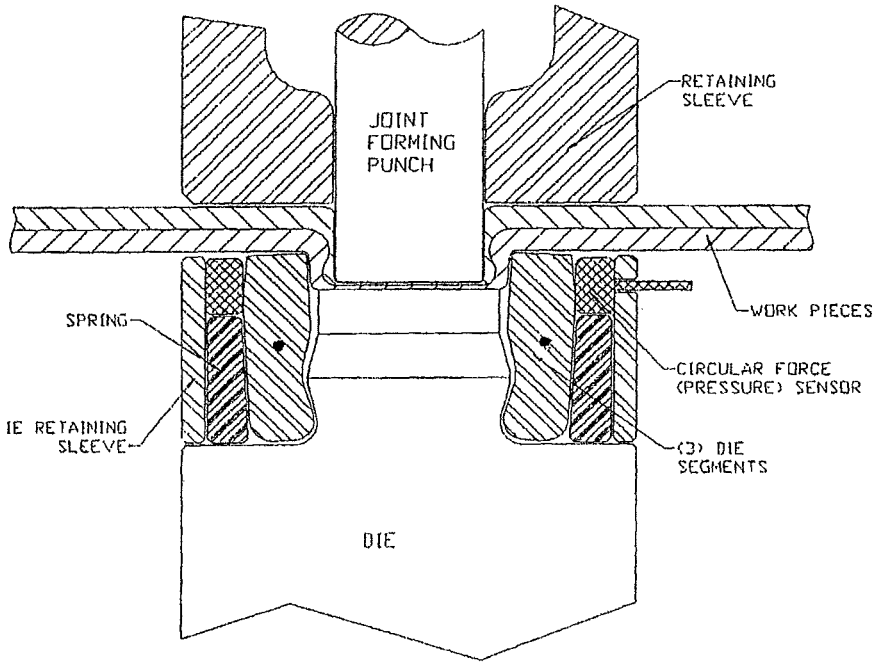
FIG. 3 is a view similar to FIG. 2, but illustrating different monitoring components.

Other types of actuators can be used to drive the punch. Sliding die segments can be used instead of pivoting die segments. Other types of sensors, e.g., strain gauges or load cells, can be used to sense displacement of the die segments. For example, FIG. 3 shows an embodiment in which a circular force (pressure) sensor is used to sense displacement of the die segments. The spring or springs used in each embodiment may be of any appropriate well-known type, such as coil springs, leaf springs, or wave springs. The sensor may be piezoelectric, for example. Appropriate displacement sensors can include electrical, magnetic, optical, mechanical, and electro-mechanical sensors, for example.

Software employed in a microprocessor of the controller can be designed so that actuation of any one sensor or any combination of sensors can be used to cut off the punch drive. Proximity switches have an on-off operating characteristic, but other sensors may have an operating characteristic that varies continuously or in discrete steps. Time delay between actuations of sensors can be used as a basis for control also. The need for punch/die replacement due to wear can depend upon a predetermined number of clinching cycles in which inappropriate button diameters and/or bottom thickness are detected.

The controller can store information representative of a predetermined range of acceptable button diameters, as well as information representative of a predetermined acceptable range of punch movement. If the punch has to move consistently (within a predetermined number of clinching cycles "X") either more or less than the predetermined range of acceptable punch movement, for the button to reach its predetermined range of acceptable diameter, this will indicate that the punch and/or die are worn out, and that joints need to be examined.

Figure 5:
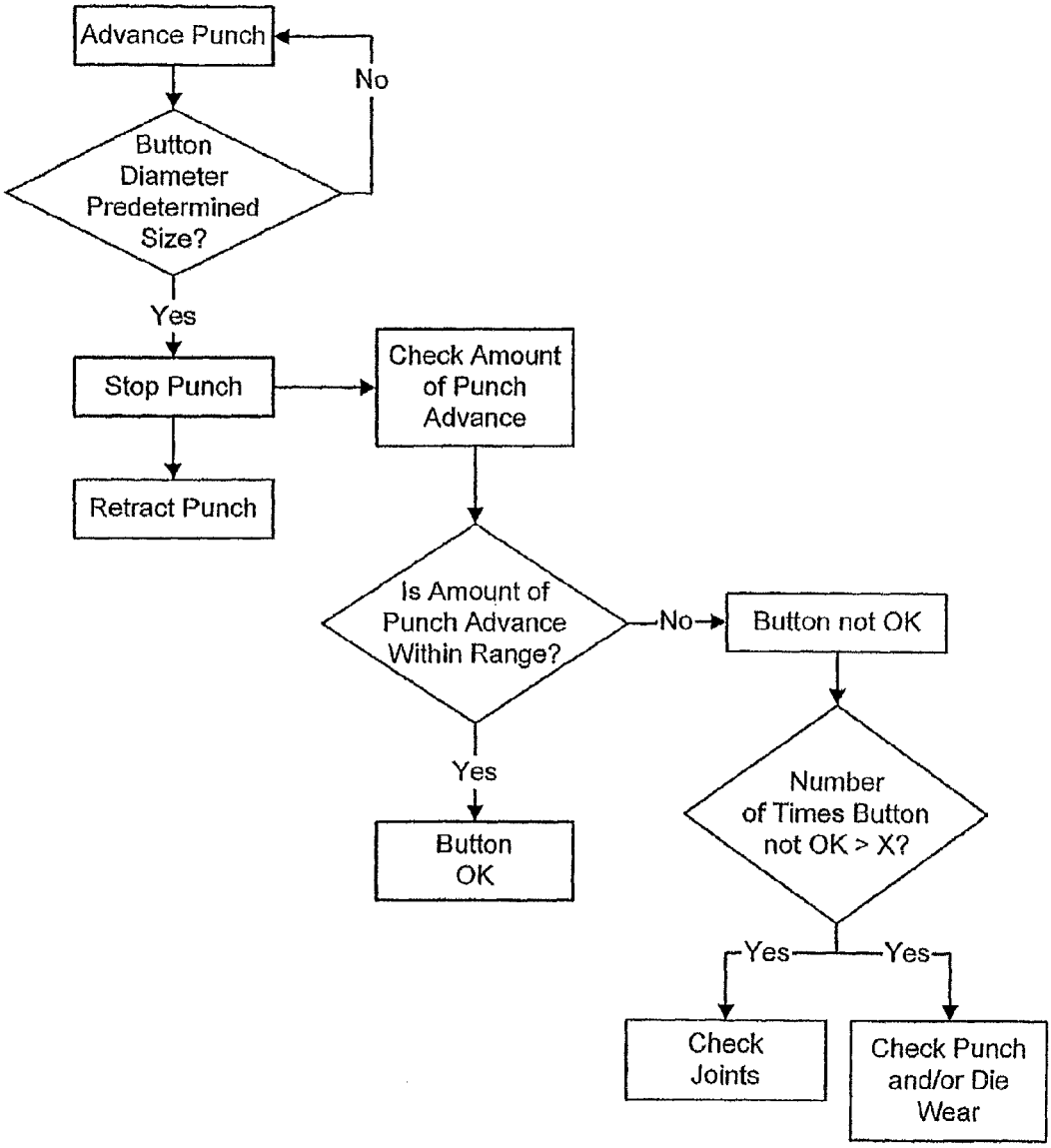
FIG. 5 is a flow chart showing the manner in which clinched joint monitoring can be performed in accordance with the invention.

FIG. 5 is a self-explanatory flowchart illustrating the manner in which a monitoring system of the invention can perform the functions just described. When a button is indicated to be "not o.k." that joint can be checked individually, or joints can be checked as a group after a predetermined number of buttons have been indicated to be "not o.k.".

Figure 6:
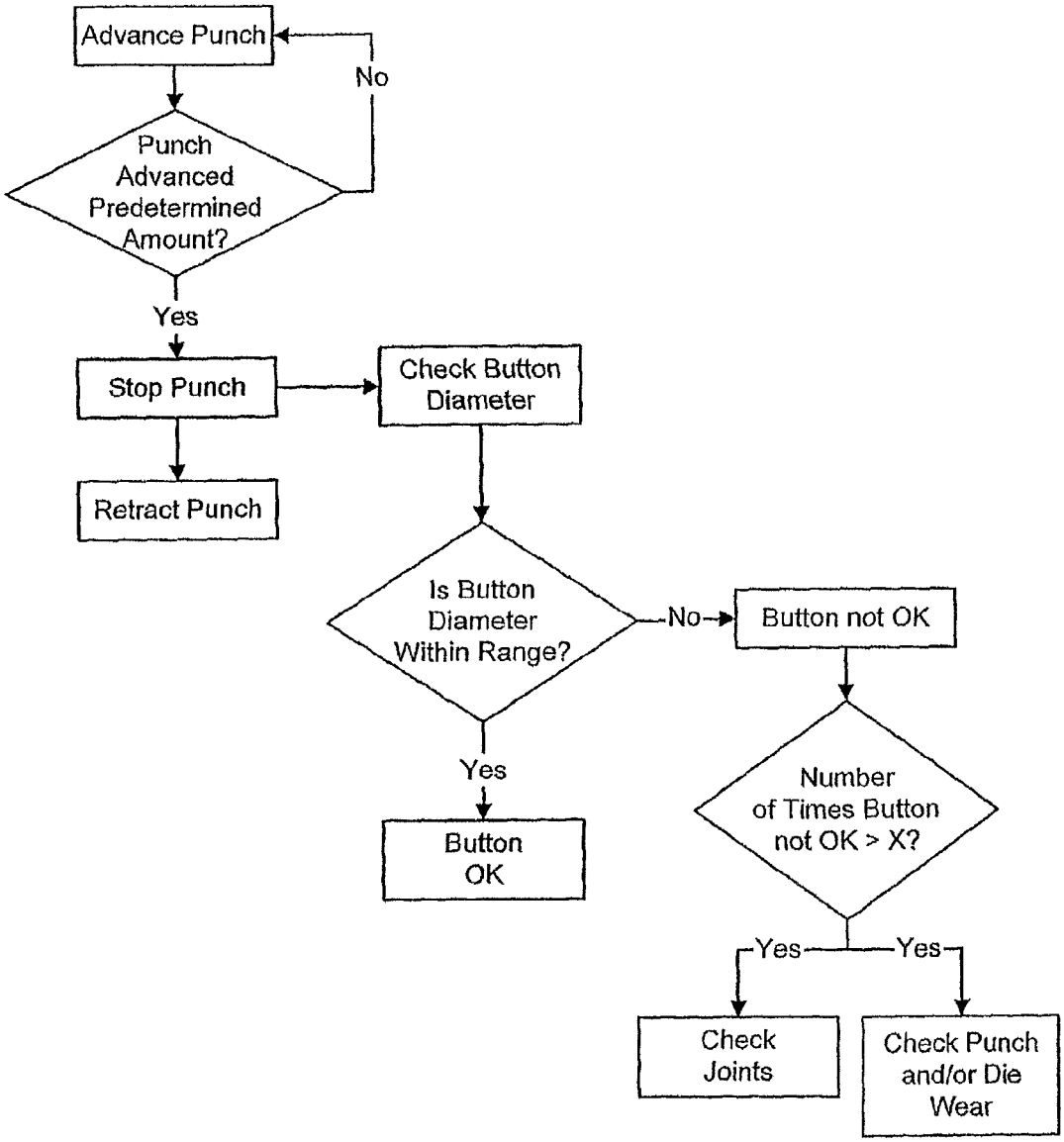
FIG. 6 is a similar flow chart for another embodiment.

In another embodiment, as shown in FIG. 6, for example, instead of stopping punch advancement in response to the sensor device that determines button diameter and then determining joint acceptability by the amount of punch advancement, the controller can direct the actuator to advance the punch and then to stop when the punch advancement is within a predetermined range of acceptable punch advancement, and the output of the sensor device at that time can be used to determine whether the button is within a predetermined range, and hence whether the joint is acceptable. In this embodiment, a sensor device having outputs that vary continuously or in discrete steps is particularly appropriate for determining button diameter.

In general, the controller correlates the size of the button of the clinched joint with the amount of punch advancement in producing the joint and determines from such correlation whether the joint is acceptable.

While preferred embodiments of the invention have been shown and described, it will be apparent that modifications can be made without departing from the principles and spirit of the invention, the scope of which is defined in the appended claims. For example, various described features of the invention can be used individually, or in different combinations of features, as may be desired.

What is claimed is:

1. A system for monitoring clinched joints performed by an apparatus that comprises a punch moved relative to a die, wherein the system determines acceptability of a clinched joint by correlating the amount of punch advancement toward the die in the formation of a joint and the diameter of a button of the joint.

2. A system according to claim 1, wherein the die includes a plurality of segments and the diameter of the button is determined by a sensor device responsive to movement of an at least one die segment that moves laterally relative to a die anvil during formation of the clinched joint.

3. A system according to claim 2, wherein advancement of the punch toward the die is stopped when the sensor device determines a predetermined diameter of the button of the clinched joint, and then the acceptability of the clinched joint is determined by whether the amount of punch advancement is within a predetermined range.

4. A system according to claim 2 wherein the punch is advanced by a predetermined amount during formation of the clinched joint and, when advancement of the punch stops, then the acceptability of the clinched joint is determined by whether the diameter of the button of the clinched joint as determined by the sensor device is within a predetermined range.

5. A method for monitoring clinched joints performed by an apparatus that comprises a punch moved relative to a die, comprising correlating the amount of punch advancement toward the die in the formation of a joint and the diameter of a button of the joint and thereby determining acceptability of the joint.

6. A method according to claim 5, wherein the diameter of the button is determined by operation of a sensor device responsive to movement of at least one die segment that moves laterally relative to a die anvil during formation of the clinched joint.

7. A method according to claim 6, wherein advancement of the punch toward the die is stopped when the sensor device determines a predetermined diameter of the button of the clinched joint.

8. A method according to claim 6, wherein the punch is advanced by a predetermined amount during formation of the clinched joint and when advancement of the punch stops, the diameter of the button of the clinched joint is determined by the sensor device.

* * * * *